US007442109B2

(12) United States Patent
Fosbenner et al.

(10) Patent No.: US 7,442,109 B2
(45) Date of Patent: Oct. 28, 2008

(54) ARTICULATED, STEERABLE, TOY VEHICLE

(75) Inventors: Mary Ellen Fosbenner, Riverton, NJ (US); Jean Marie Newton, Marlton, NJ (US); Robert A. Butkiewicz, Shamong, NJ (US); Jeffrey Osnato, Cranford, NJ (US); Francis E. Ponton, Marlton, NJ (US); Jeremy S. Robotham, Mt. Laurel, NJ (US)

(73) Assignee: Mattel, Inc., El Segundo, CA (US)

( * ) Notice: Subject to any disclaimer, the term of this patent is extended or adjusted under 35 U.S.C. 154(b) by 114 days.

(21) Appl. No.: 10/894,179

(22) Filed: Jul. 19, 2004

(65) Prior Publication Data

US 2005/0106993 A1 May 19, 2005

Related U.S. Application Data

(60) Provisional application No. 60/520,056, filed on Nov. 14, 2003.

(51) Int. Cl.
*A63H 33/02* (2006.01)
*A63H 17/00* (2006.01)

(52) U.S. Cl. ..... 446/451; 446/465

(58) Field of Classification Search ..... 446/75, 446/431, 450, 451, 449, 469, 465, 468, 168, 446/170, 174, 275, 432, 434, 435; 74/606 R, 74/435, 89.18; 192/56.1; 464/30
See application file for complete search history.

(56) References Cited

U.S. PATENT DOCUMENTS 2,260,679 A * 10/1941 Neilson ..... 446/451
2,551,036 A * 5/1951 Mills ..... 446/315
2,651,882 A * 9/1953 Core ..... 446/451
2,887,823 A * 5/1959 Vaughan ..... 446/451
3,286,397 A * 11/1966 Lohr ..... 446/460
3,747,265 A * 7/1973 Gagnon ..... 446/425
4,291,489 A * 9/1981 McCarthy, Jr. ..... 446/451
4,317,307 A 3/1982 Conry
4,366,645 A * 1/1983 Crain et al. ..... 446/434
4,573,941 A * 3/1986 Holden et al. ..... 446/451
4,580,802 A * 4/1986 Herman et al. ..... 280/267
4,595,380 A * 6/1986 Magers ..... 446/451
4,659,320 A * 4/1987 Rich et al. ..... 446/435
4,708,683 A * 11/1987 Lehmann et al. ..... 446/75
4,741,718 A 5/1988 Moolman
4,765,636 A * 8/1988 Speer ..... 280/47.11
5,154,658 A * 10/1992 Marcus ..... 446/411

(Continued)

FOREIGN PATENT DOCUMENTS

GB 2271516 A * 4/1994

*Primary Examiner*—Gene Kim
*Assistant Examiner*—Alyssa M Hylinski
(74) *Attorney, Agent, or Firm*—Panitch Schwarze Belisario & Nadel LLP

(57) ABSTRACT

An articulated, steerable, toy vehicle includes a first wheeled vehicle portion and a second wheeled vehicle portion pivotally coupled thereto. A steering lever has a free first end and an opposing second end pivotally coupled to the second wheeled vehicle portion and operably coupled to the first wheeled vehicle portion through the second wheeled vehicle portion. Rotation of the steering lever relative to the second wheeled vehicle portion pivots the first wheeled vehicle portion relative to the second wheeled vehicle portion.

20 Claims, 8 Drawing Sheets

U.S. PATENT DOCUMENTS 5,240,451 A * 8/1993 Clark, Jr. ..... 446/465
5,281,184 A 1/1994 Suimon
5,303,944 A * 4/1994 Kalmus ..... 280/288.4
5,389,031 A * 2/1995 Sharpe et al. ..... 446/409
5,584,743 A 12/1996 Beaulieu
6,176,759 B1 1/2001 Trageser
6,272,946 B1 * 8/2001 Roux ..... 74/498
6,405,817 B1 6/2002 Huntsberger et al.
6,488,563 B1 * 12/2002 Isaacson ..... 446/450
6,527,619 B1 * 3/2003 Agostini et al. ..... 446/435
2001/0005663 A1 * 6/2001 Max ..... 446/465

* cited by examiner

ARTICULATED, STEERABLE, TOY VEHICLE

CROSS-REFERENCE TO RELATED APPLICATIONS

This application claims the benefit of U.S. Provisional Pat. Application No. 60/520,056, entitled "Walk Behind, Steerable Toy Vehicle", filed Nov. 14, 2003.

BACKGROUND OF THE INVENTION

The present invention relates generally to toy vehicles, and more particularly to an articulated toy vehicle that is steerable using a steering lever.

Steerable toy vehicles are generally known. One form of steerable toy vehicle consists of a wheeled vehicle with a steering assembly, generally a steering wheel and shaft, extending rearwardly therefrom. Actuation of the steering assembly generally causes pivoting of the front wheels independly from the toy vehicle. In this way, a user pushes the toy vehicle in front of him and turns the steering wheel to steer it.

Articulated toy vehicles are also generally known. Although some of the known articulated toy vehicles are also steerable, they are generally steerable using a similar mechanism to that described above which pivots the front wheels independently from the toy vehicle. However, none have steering assemblies that allow a user walking behind the toy vehicle to guide the toy vehicle along a surface by pivoting a first articulated member of the articulated toy vehicle. It is believed that a toy vehicle having such a steering mechanism would be desirable.

BRIEF SUMMARY OF THE INVENTION

Briefly stated, the present invention is an articulated, steerable, toy vehicle comprising a first wheeled vehicle portion. A second wheeled vehicle portion is pivotally coupled with the first wheeled vehicle portion. A steering lever has a free first end and an opposing second end pivotally coupled to the second wheeled vehicle portion for lateral side-to-side movement of the free first end over the pivotally coupled first and second wheeled vehicle portions and operably coupled to the first wheeled vehicle portion through the second wheeled vehicle portion. Lateral side-to-side pivotal movement of the free first end of the steering lever relative to the second wheeled vehicle portion pivots the first wheeled vehicle portion relative to the second wheeled vehicle portion.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
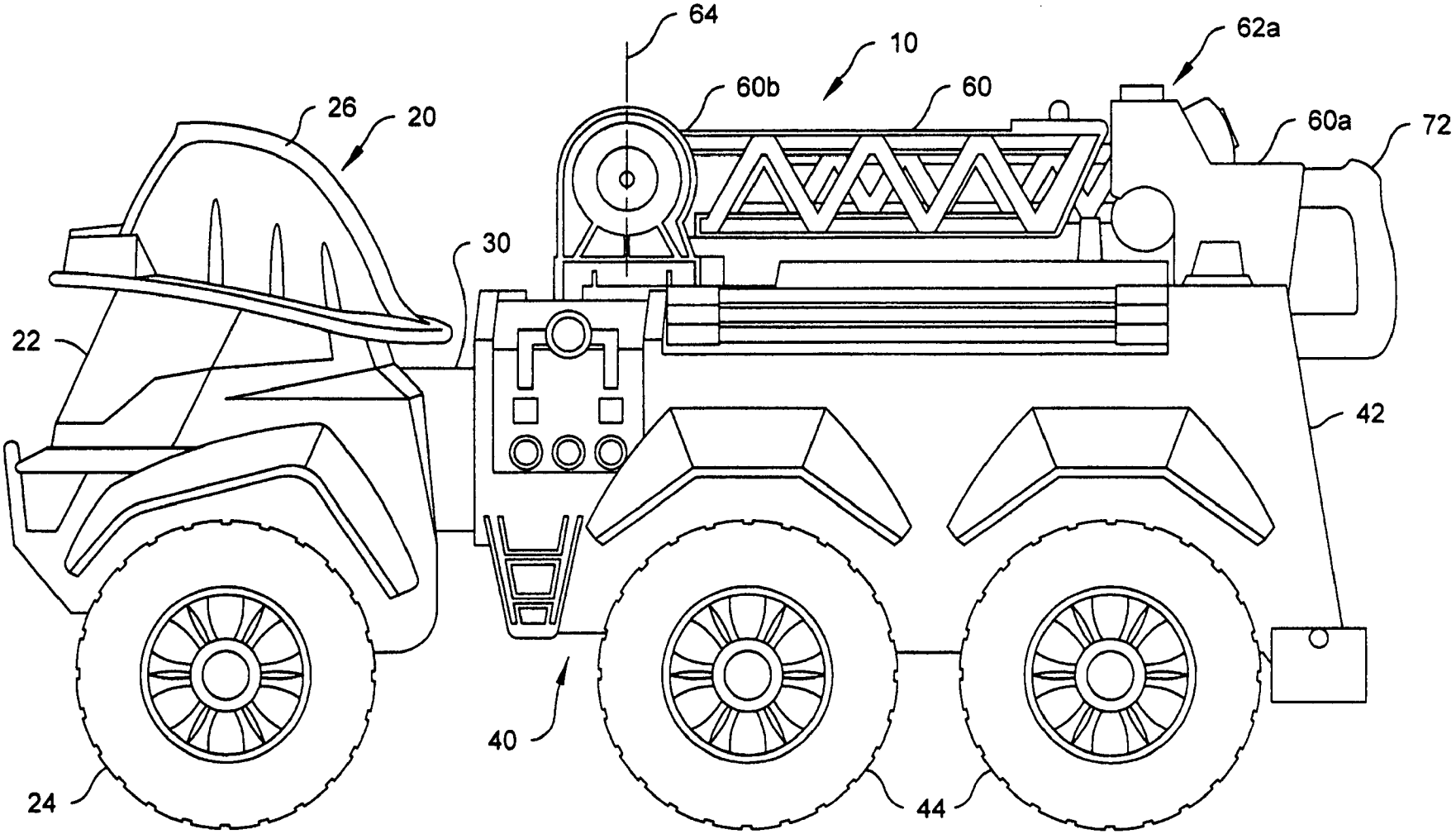
FIG. 1 is a side elevational view of a toy vehicle in accordance with a preferred embodiment of the present invention with a steering lever in a collapsed configuration.

Certain terminology is used in the following description for convenience only and is not limiting. The words "right," "left," "upper," and "lower" designate directions in the drawings to which reference is made. The terminology includes the words above specifically mentioned, derivatives thereof, and words of similar import.

Referring to the drawings in detail, wherein like numerals indicate like elements throughout, there is shown in FIGS. 1-7 an exemplary articulated, steerable, toy vehicle, indicated generally at 10, having a steering lever 60 in accordance with the present invention.

Figure 2:
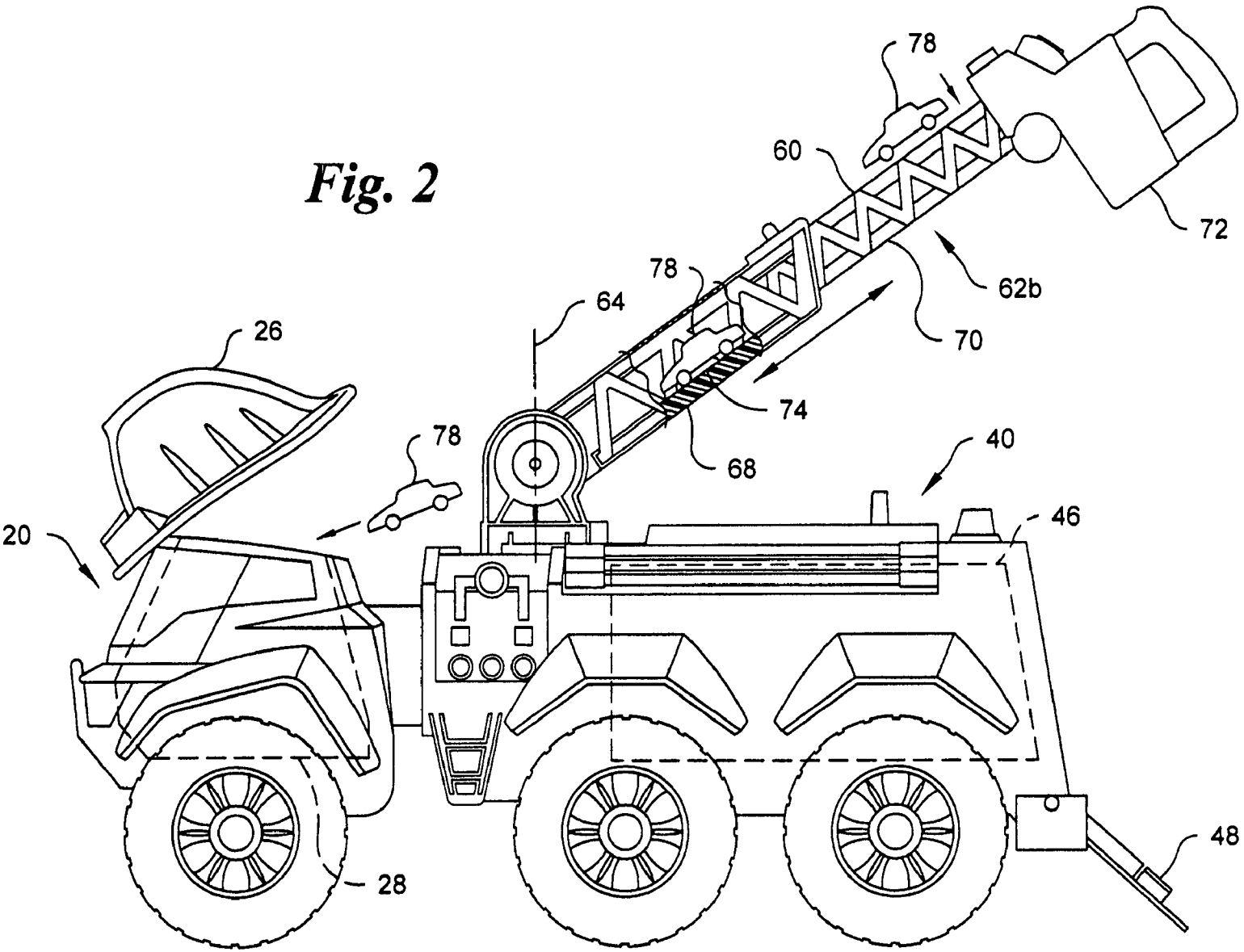
FIG. 2 is a side elevational view of the toy vehicle of FIG. 1 with the steering lever in an extended configuration and a lid and rear door open.
Figure 3:
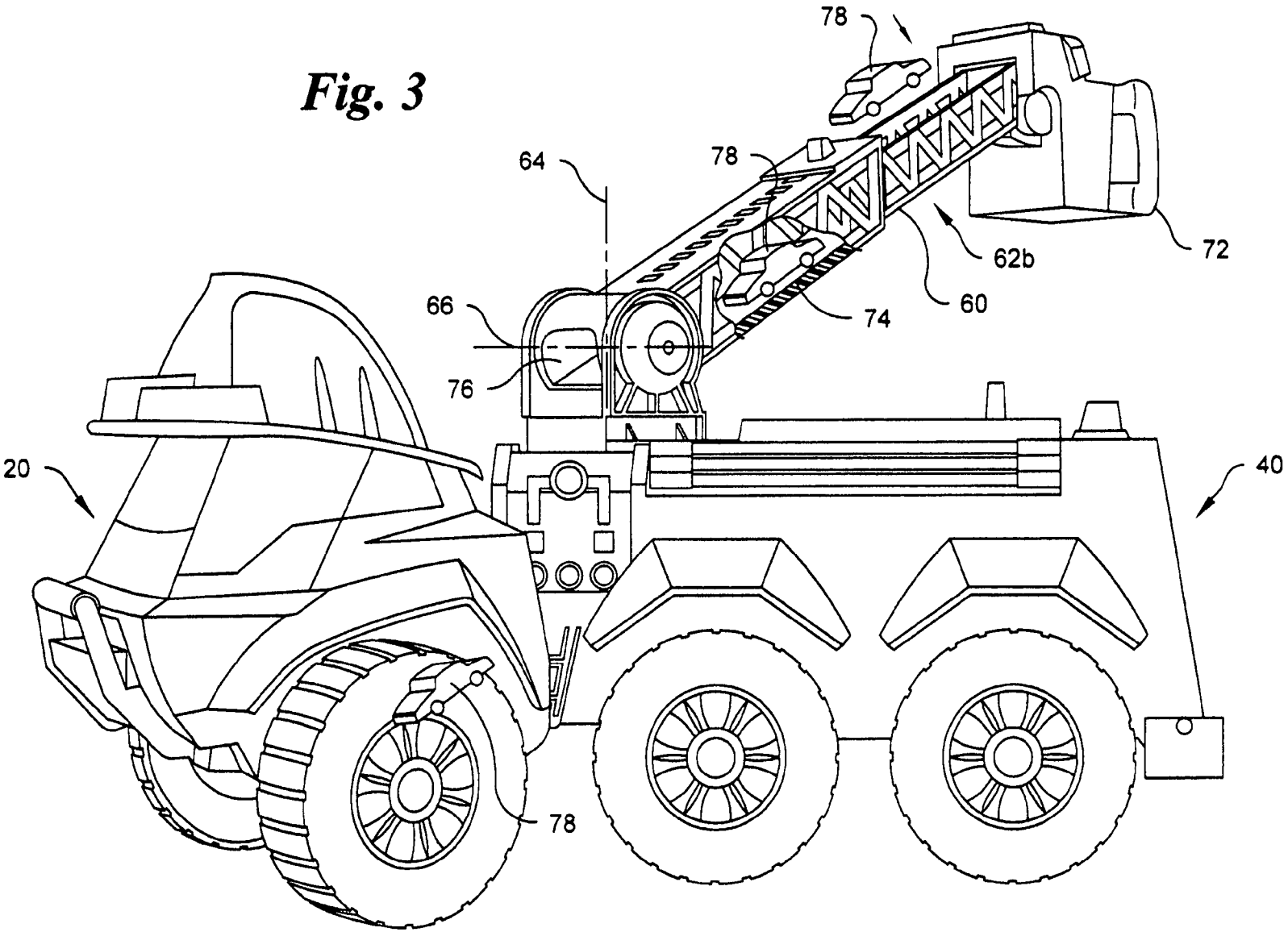
FIG. 3 is a side elevational view of the toy vehicle of FIG. 1 with the steering lever and a first wheeled vehicle portion rotated.

With particular reference to FIGS. 1-3, the exemplary toy vehicle 10 is a fire truck including a first wheeled vehicle portion or tractor assembly 20 and a second wheeled vehicle portion or trailer assembly 40 pivotally coupled with the tractor assembly 20 using a pivot member 30. The tractor assembly 20 has a generally hollow tractor vehicle body 22 with a first plurality of wheels 24 (preferably two) rotatably connected thereto. The tractor vehicle body 22 preferably has a hollow tractor storage compartment 28 (in phantom in FIG. 2) within which a user can store things, including miniature, diminutive toy vehicles 78 having a scale reduced even from the scale of the toy vehicle 10, such as 1/64-scale Matchbox® cars, for instance. Preferably, the tractor storage compartment 28 has a tractor storage compartment lid 26 at the top of the tractor vehicle body 22 and the tractor assembly 20 to selectively cover an opening of the tractor storage compartment 28. The tractor storage compartment lid 26 is preferably pivotably engaged with the front of the tractor vehicle body 22 so as to pivot forwardly when opening. Although the tractor storage compartment lid 22 is shown as having the shape of a fire fighter's helmet, it is not intended to be limiting. As such, it is within the spirit and scope of the present invention that the tractor storage compartment lid 22 be of any shape.

The trailer assembly 40 has a trailer vehicle body 42 with a second plurality of wheels 44 (preferably four) rotatably connected thereto. Preferably, the trailer vehicle body 42 has a hollow trailer storage compartment 46 (in phantom in FIG. 2) for the storage of various items such as the diminutive toy vehicles 78. The trailer storage compartment 46 preferably has a trailer storage compartment door 48 at the back of the trailer vehicle body 42. Preferably, the trailer storage compartment door 48 pivots about a lower edge so as to form a ramp from the ground to the trailer storage compartment 46 when in an open position (FIG. 2) to enable the user to roll diminutive toy vehicles 78 in to and out of the trailer storage compartment 46.

Steering lever 60 is rotatably coupled to the trailer assembly 40 for rotation along mutually perpendicular axes in first and second directions. The steering lever 60 is preferably configured to have the appearance of an extensible or telescopic fire ladder, preferably mounted on the trailer assembly 40. The steering lever 60 has a free first end 60*a* and an opposing attached second end 60*b* pivotally coupled to the trailer assembly 40 for lateral side-to-side movement of the free first end 60*a* over the pivotally coupled tractor and trailer assemblies 20, 40 and operably coupled to the tractor assembly 20 through the trailer assembly 40. A steering handle 72 preferably is connected to the first end 60*a* of the steering lever 60. The handle 72 is adapted to be comfortably grasped by the user. Pivotal movement of the steering lever 60 relative to the trailer assembly 40 is about a preferably substantially vertical first pivot axis 64 preferably parallel to another pivot axis 93 (see FIG. 4) about which the tractor assembly 20 pivots relative to the trailer assembly 40 so as to allow the toy vehicle 10 to turn either left or right. The steering lever 60 is further coupled to the trailer assembly 40 to pivot about a preferably at least substantially horizontal second pivot axis 66 such that a height of the free first end 60*a* and the angle of incline of the steering lever 60 to the horizontal can be adjusted.

The steering lever 60 is preferably adjustable in length and capable of movement between an extended configuration 62*b* (see FIG. 2) and a collapsed or stored configuration 62*a* (see FIG. 1). Preferably, the steering lever 60 is telescopic having a lower, outer portion 68 engaged with the trailer assembly 40 and an upper, inner portion 70 slidingly engaged within the lower portion 68. Preferably, in the collapsed or stored configuration, the upper portion 70 is retained substantially entirely within the lower portion 68. Preferably, in the extended configuration, the upper portion 70 is minimally retained within the lower portion 68 so as to extend outwardly from the end of the lower portion 68.

Within the steering lever 60 is a channel or track 74 extending at least substantially along the length of the steering lever 60 at least to and through the second end 60*b* of the steering lever 60. Preferably, the track 74 extends through the upper and lower portions 70, 68 of the steering lever 60 and is sized so as to accommodate at least one miniature toy vehicle 78 therein. At least one of the upper and lower portions 70, 68 (preferably the upper portion 70) of the steering lever 60 has an open top to allow a miniature toy vehicle 78 to be placed within the track 74 by the user. The miniature toy vehicle 78 is of a size that is sufficiently small to pass through the track 74 and exit the track 74 from a track discharge opening 76 at the second end 60*b* of the steering lever 60. The track discharge opening 76 can be aligned with the opening of the tractor storage compartment 28 so that, when the tractor storage compartment lid 26 is open, the tractor storage compartment 28 can receive miniature toy vehicles 78 or other objects passed along the track 74, as shown in FIG. 2. Alternatively, the track discharge opening 76 can be oriented such that the miniature toy vehicles 78 exit from the vehicle 10 onto a surface (not shown) on which the vehicle 10 is supported, as shown in FIG. 3.

Figure 4:
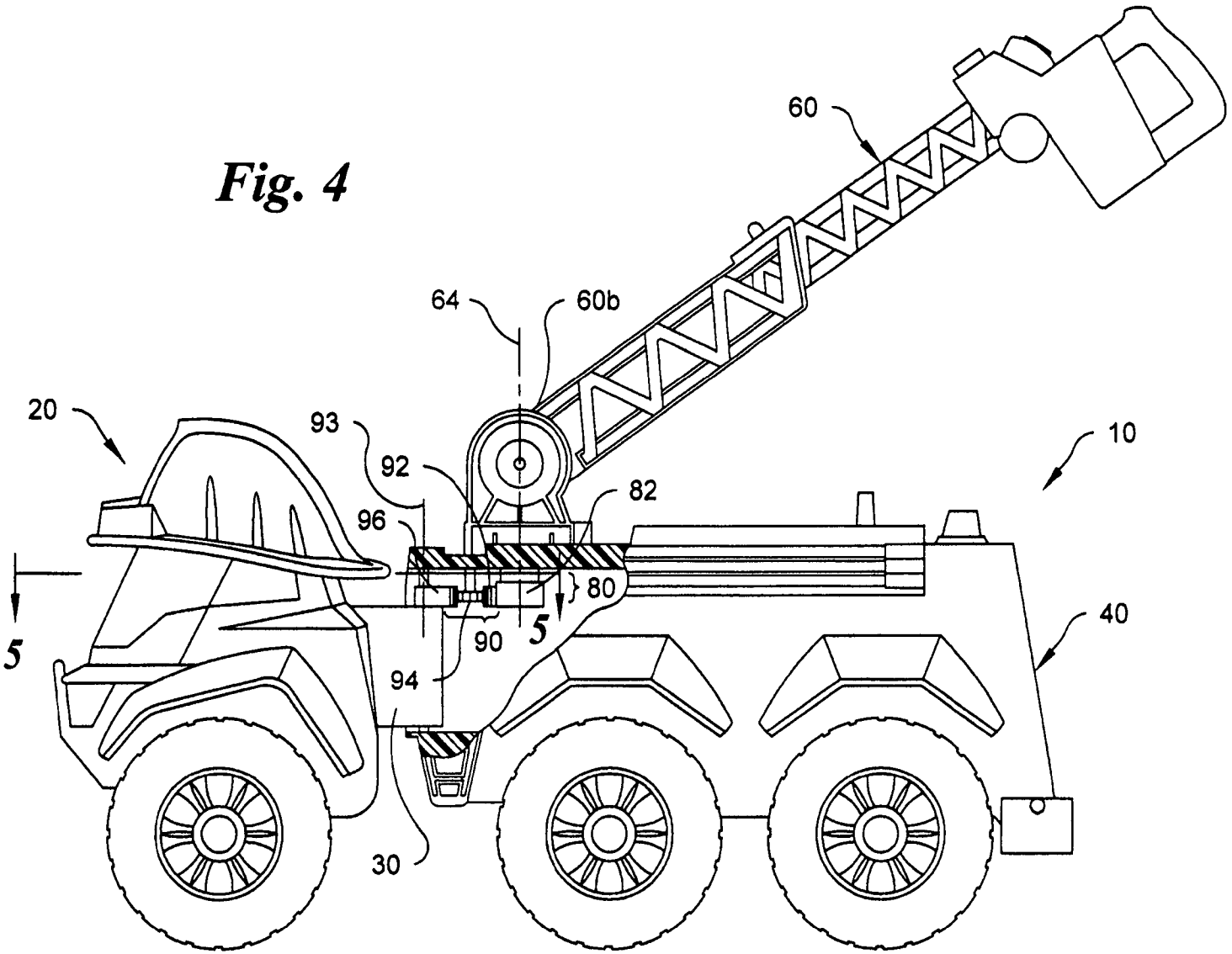
FIG. 4 is a side elevational view of the toy vehicle of FIG. 1 with a portion of the toy vehicle cut away to show a geared steering embodiment.
Figure 5:
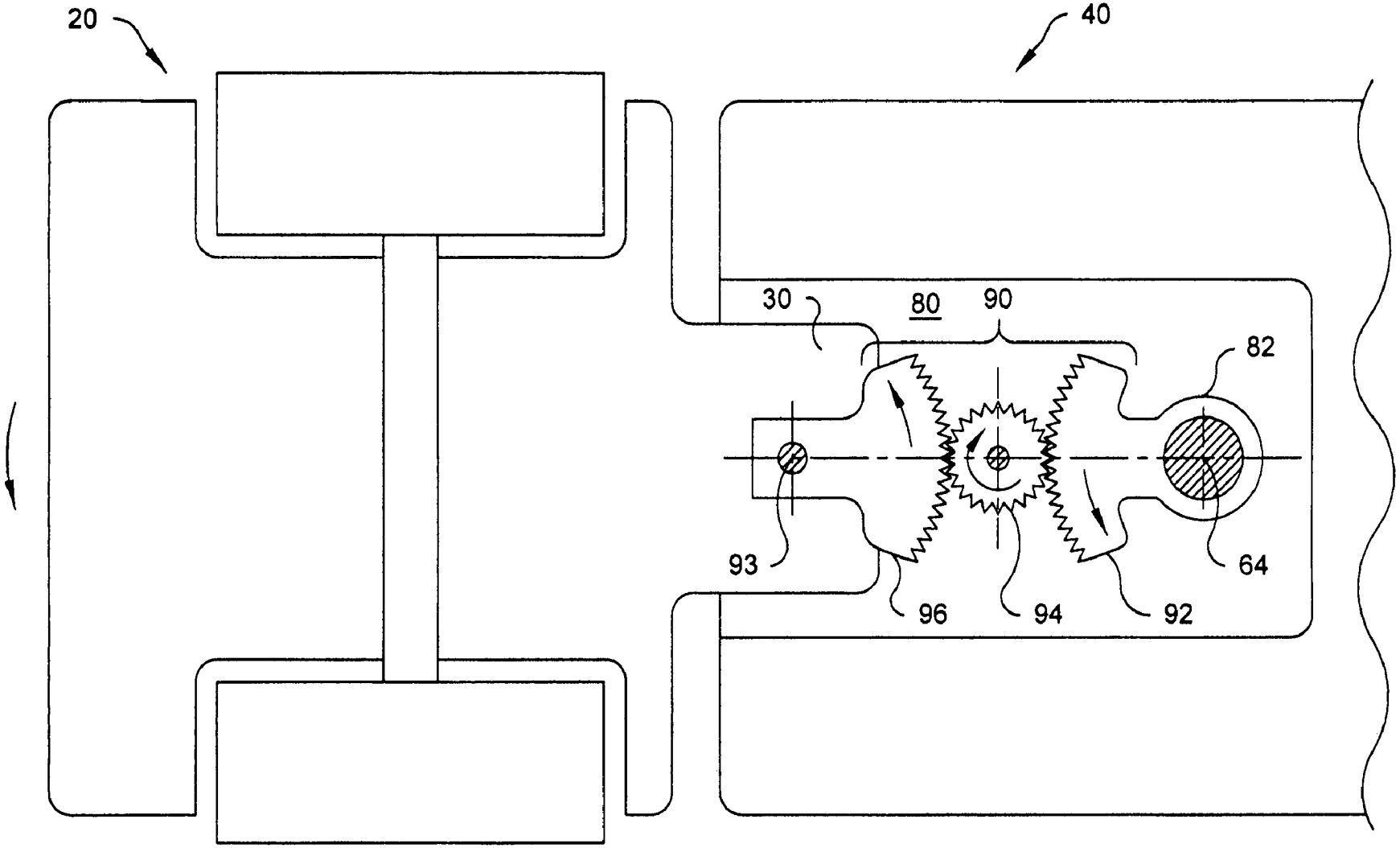
FIG. 5 is a diagrammatic cross-sectional view of the operable coupling of FIG. 4 taken along line 5-5.

Referring now to FIGS. 4 and 5, the toy vehicle 10 further comprises an operable coupling 80 including a first rotational drive member 82 drivingly engaged with a geared steering mechanism 90 between the second end 60*b* of the steering lever 60 and the tractor assembly 20. The first rotational drive member 82 preferably is fixedly coupled through the top of the trailer assembly 40 with a yoke 83 that pivotally receives the lower, second end 60*b* of the steering lever 60 for up and down pivotal movement of the steering lever 60 about a horizontal axis 66 (see FIG. 3). The yoke 83 and the first rotational drive member 82 rotate together as a single assembly about the axis 64 for pivotal movement or rotation of the steering lever 60 about the same vertical axis 64. The geared steering mechanism 90 preferably comprises a first sector gear 92, at least one idler gear 94, and a second sector gear 96. The first sector gear 92 is fixedly connected to the first rotational drive member 82, which, in turn, is fixedly connected to the steering lever 60, to enable the first sector gear 92 to pivot with the steering lever 60. The at least one idler gear 94 is operably engaged (meshed) with the first sector gear 92. The second sector gear 96 is operable engaged with the idler gear 94 and is fixedly connected to the tractor assembly 20. Preferably, the second sector gear 96 is fixedly connected to the pivot member 30 which is, in turn, fixedly connected to the tractor assembly 20. In this way, rotation of the steering lever 60 about the vertical first pivot axis 64 causes rotation of the first sector gear 92 which imparts rotation to the idler gear 94. Rotation of the idler gear 94 causes the second sector gear 96 to rotate, which consequently causes the tractor assembly 20 to pivot relative to the trailer assembly 40 about an axis 93.

Figure 8:
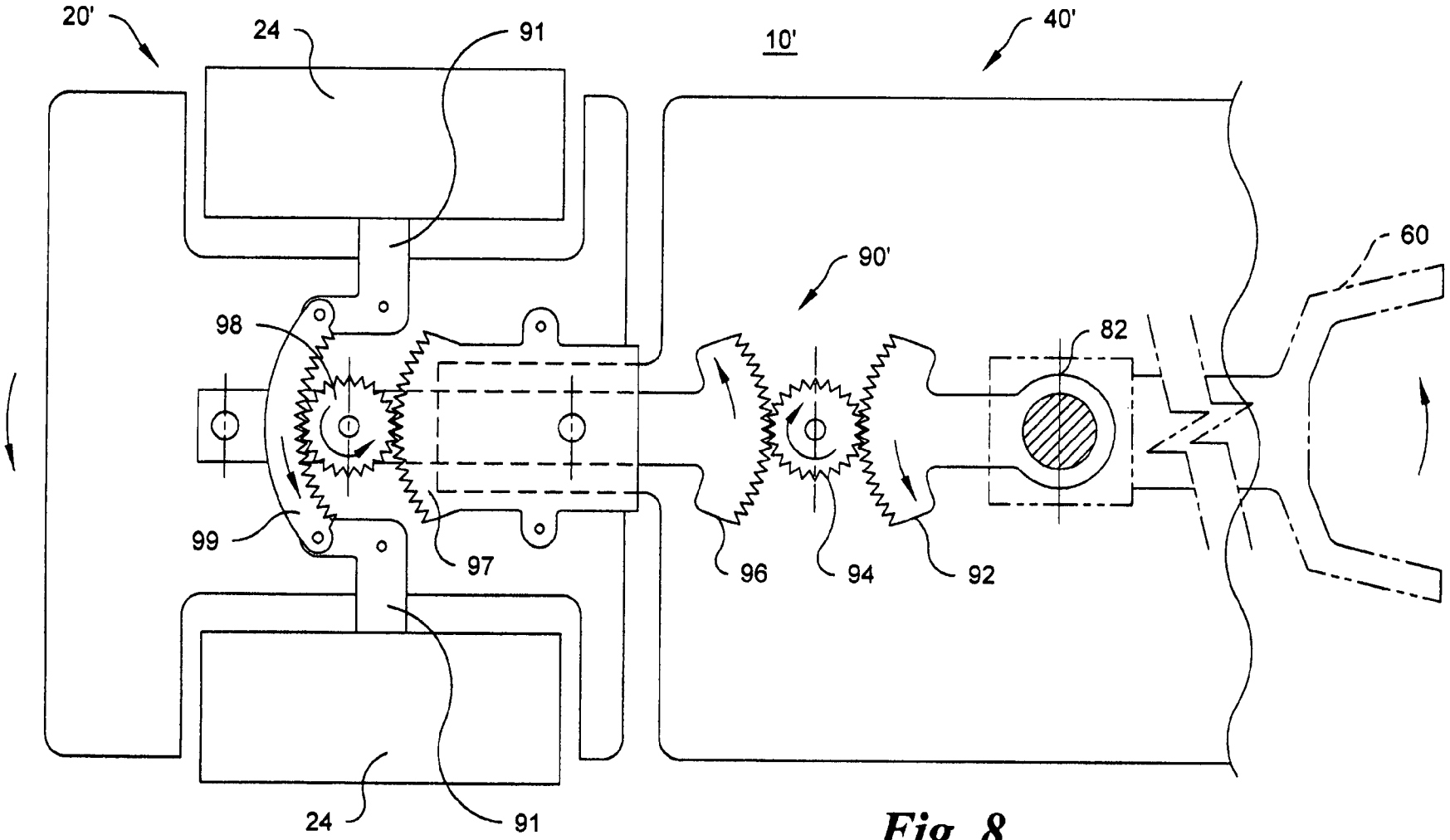
FIG. 8 is a cut-away view of the toy vehicle of FIG. 1 having an alternative geared steering embodiment.

Referring to FIG. 8, alternatively, a geared steering mechanism 90' may further comprise a third sector gear 97, which is fixedly connected to the trailer assembly 40', and a second idler gear 98, which is rotatably mounted to the tractor assembly 20' and is operably engaged with the third sector gear 97 and also with a fourth sector gear 99. Steering arms 91 are pivotably coupled with the tractor assembly 20', preferably with one steering arm 91 on either lateral side of the tractor assembly 20'. The steering arms 91 are also pivotally coupled with opposing ends of the fourth sector gear 99. One tractor wheel 24 is operably coupled to the each steering arm 91. This alternate geared steering mechanism 90' pivots the tractor assembly 20' with rotation of the steering lever 60 in much the same way as described above for the first embodiment 10. However, additionally, the pivoting of the tractor assembly 20' with respect to the third sector gear 97 causes rotation of the second idler gear 98 within the tractor assembly 20, which, in turn, causes side-to-side translation of the fourth sector gear 99. Movement of the fourth sector gear 99 causes the steering arms 91 to pivot in unison (both in the same direction) with respect to the tractor assembly 20', in turn causing the tractor wheels 24 to pivot with respect to the tractor assembly 20'. In this way, in addition to pivoting the tractor assembly 20' with respect to the trailer assembly 40', rotation of the steering lever 60 also causes the tractor wheels 24 to pivot with respect to the tractor assembly 20' to better simulate the turning of an actual articulated vehicle. It should be appreciated that the tractor and trailer assemblies 20', 40' differ from tractor and trailer assemblies 20, 40 of the first vehicle 10 only to the extent to accommodate the geared steering mechanism 90'.

Figure 6:
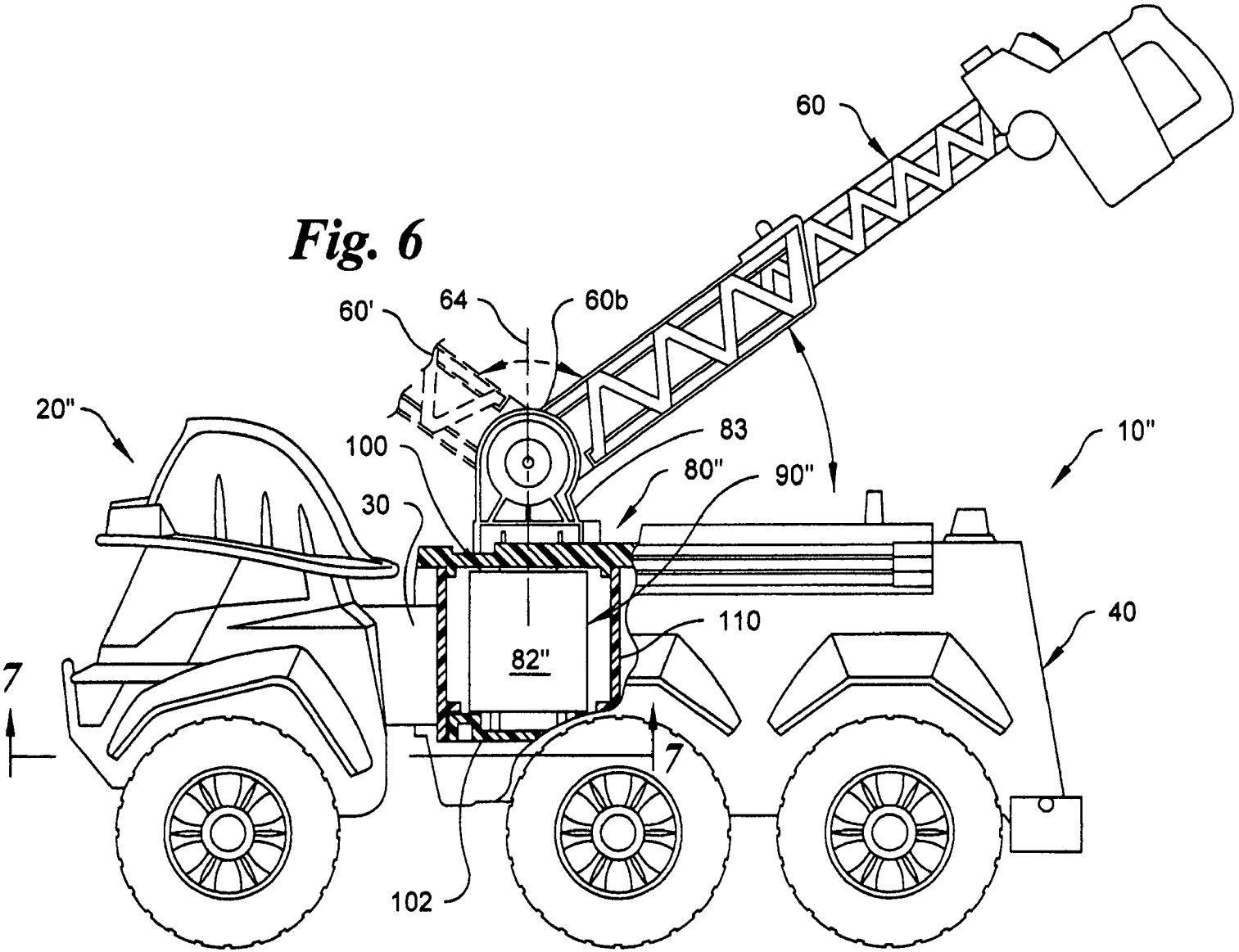
FIG. 6 is a side elevational view of the toy vehicle of FIG. 1 with a portion of the toy vehicle cut away to show an interference/slip clutch embodiment.
Figure 7:
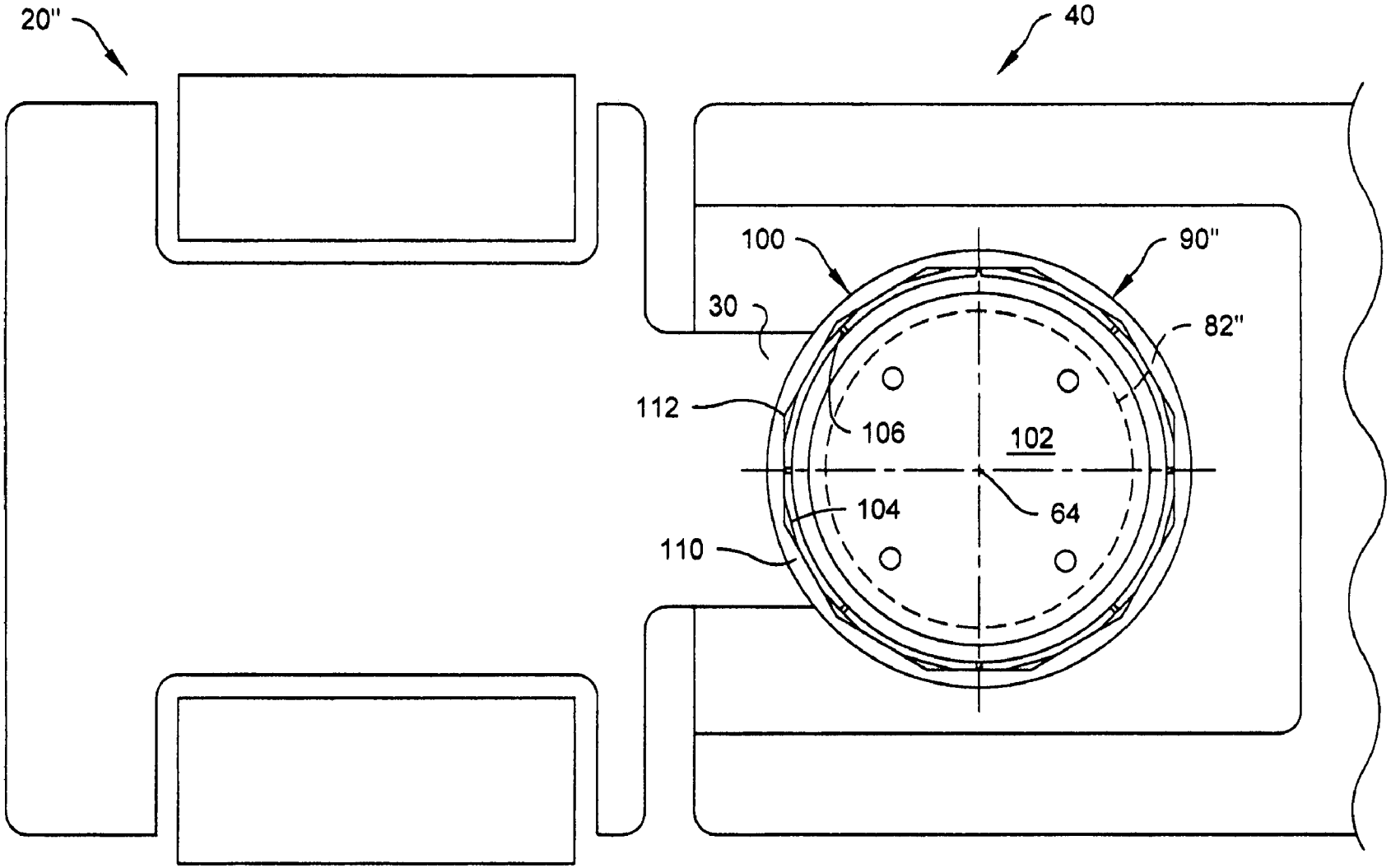
FIG. 7 is a diagrammatic cross-sectional view of the operable coupling of FIG. 6 taken along line 7-7.

Referring now to FIGS. 6 and 7, a toy vehicle 10" may alternatively comprise an operable coupling 80" having a steering mechanism 90" preferably including at least a slip clutch assembly 100 between the second end 60*b* of the steering lever 60 and the tractor assembly 20. The slip clutch assembly 100 comprises a first rotational drive member 82" and a second rotational drive member 110. The first rotational drive member 82" is fixedly coupled with the second end 60*b* of the steering lever 60 to pivot with the steering lever 60 about the first pivot axis 64. The second rotational drive member 110 is fixedly coupled with the tractor assembly 20" or, more specifically, to the pivot member 30, to rotate with the tractor assembly 20" about the first pivot axis 64. Preferably, the second rotational drive member 10 is a collar having open upper and lower ends with a hollow interior volume having an interior perimeter 112. A cupped drive disk 102 is fixedly connected to the first rotational drive member 82" for rotation therewith. The cupped drive disk 102 has a circumferential outer perimeter 104 that is at least partially received in the hollow interior of the second rotational drive member 110. The outer perimeter 104 of the drive disk 102 is sized and shaped to engage the inner perimeter 112 of the interior volume of the second rotational drive member 110 to rotate the second rotational drive member 110 below a threshold torque and to release and rotate with respect to the second rotational drive member 110 above the threshold torque. Preferably, the inner perimeter 112 of the second rotational drive member 110 is of a first polygon shape having a first number of sides and the circumferential outer perimeter 104 of the drive disk 102 is of a second polygon shape having a second number of sides which is a multiple of the first number. Preferably, the inner perimeter 112 of the second rotational drive member 110 has twelve sides and the outer perimeter 104 of the drive disk 102 has twenty-four sides, although it is within the spirit and scope of the present invention that the drive disk outer perimeter 104 and the second rotational drive member interior perimeter 112 have any number of sides. It is further preferable that the drive disk 102 includes a plurality of slots 106 through the circumferential outer perimeter 104 to allow the outer perimeter 104 of the drive disk 102 to flex above the threshold torque. One or a pair of similar slip clutches or other slip clutches can be provided between the lateral sides of the second end 60*b* of the steering lever 60 and an inner side of the yoke 83 to allow the steering lever/ladder 60 to support itself in elevated position as shown in FIGS. 2-4. Alternatively, one or a pair of spring clutches (not shown) may be used with the steering lever/ladder 60. Specifically, the spring clutch has two interfacing disks (not shown), one engaged with the lateral side of the second end 60*b* of the steering lever 60 and the other engaged with the inner side of the yoke 83. The disks are spring biased toward each other with each disk having a face having radial ribs (not shown) thereon. When the steering lever/ladder 60 is raised or lowered, the spring is overcome to allow the ribs of one disk slip past the ribs of the other disk. However, when it is desired that the steering lever/ladder 60 be held in a particular position, the spring maintains the disks, and specifically the ribs, in engagement with each other and act as detents in order to support the steering lever/ladder 60 in elevated position. Other surfaces with other configurations, including frictionally engaging surfaces, can be used.

Although described separately, it should be understood by those skilled in the art that the slip clutch 100 could be used within the operable coupling 80 of the geared steering embodiment. Specifically, the first rotational drive member 82 of the geared steering embodiment could be replaced with the first rotational drive member 82", the second rotational drive member 10, and the cupped drive disk 102 of the slip clutch steering embodiment. It will further be appreciated that other slip clutch assemblies, with or without gearing, could be used to operably and steerably couple together the first and second pivotally coupled vehicle portions of an articulated, steerable, toy vehicle.

The toy vehicles 10, 10', 10" are preferably constructed of convention polymeric materials, such as Acrylonityile Butadiene Styrene (ABS) plastic and polypropylene using conventional fabrication techniques well known to those of ordinary skill in the art of toy manufacture.

In operation, the toy vehicles 10, 10', 10" can be played with by a user by grasping the handle 72 and walking behind the toy vehicle, steering it by manipulating the steering lever 60 to the right and to the left. Additionally, the toy vehicles 10, 10', 10" can be used to store objects, such as the miniature toy vehicles 78, within the tractor storage compartment 28 and the trailer storage compartment 46. The track 74 within the steering lever 60 can be used to launch the miniature toy vehicle 78, either into the tractor storage compartment 28 (FIG. 2) or the ground (FIG. 3).

It will be appreciated by those skilled in the art that changes could be made to the embodiments described above without departing from the broad inventive concept thereof. For example, it will be appreciated that individual components identified are likely to be constructed from assembling together smaller pieces for ease of overall assembly of the toy vehicles. It will further be appreciated that other forms of operable coupling can be provided and that the steering ratios might be changed, for example, by varying the gear ratios. Also, by pivoting the steering lever 60 over the top of the yoke 83 to a forward position indicated in phantom at 60' in FIG. 6, any of the described vehicles 10, 10', 10" can be steered while pulling the vehicle. It is understood, therefore, that this invention is not limited to the particular embodiments disclosed, but it is intended to cover modifications within the spirit and scope of the present invention.

We claim:

1. An articulated, steerable, toy vehicle comprising:

a first wheeled vehicle portion;

a second wheeled vehicle portion pivotally coupled with the first wheeled vehicle portion; and a steering lever having a free first end and an opposing second end pivotally coupled to the second wheeled vehicle portion for rotation of the steering lever about a fixed, at least generally vertical axis located in the second wheeled vehicle portion so as to permit lateral side-to-side movement of the steering lever in at least generally horizontal directions over the pivotally coupled first and second wheeled vehicle portions and operably coupled to the first wheeled vehicle portion through the second wheeled vehicle portion such that lateral side-to-side pivotal movement of the free first end of the steering lever relative to the second wheeled vehicle portion pivots the first wheeled vehicle portion relative to the second wheeled vehicle portion.

2. The articulated, steerable, toy vehicle of claim 1 further comprising:

an operable coupling including a geared steering mechanism between the second end of the steering lever and the first wheeled vehicle portion.

3. An articulated, steerable, toy vehicle comprising:

a first wheeled vehicle portion;

a second wheeled vehicle portion pivotally coupled with the first wheeled vehicle portion; and a steering lever having a free first end and an opposing second end pivotally coupled to the second wheeled vehicle portion for lateral side-to-side movement of the first free end over the pivotally coupled first and second wheeled vehicle portions and operably coupled to the first wheeled vehicle portion through the second wheeled vehicle portion such that lateral side-to-side pivotal movement of the free first end of the steering lever relative to the second wheeled vehicle portion pivots the first wheeled vehicle portion relative to the second wheeled vehicle portion; and an operable coupling including a geared steering mechanism between the second end of the steering lever and the first wheeled vehicle portion wherein the geared steering mechanism comprises:

a first sector gear fixedly connected to the steering lever;

at least one idler gear operably engaged with the first sector gear;

a second sector gear operably engaged with the idler gear and fixedly connected to the first wheeled vehicle portion; and wherein the first wheeled vehicle portion is pivoted relative to the second wheeled vehicle portion by rotation of the steering lever about an at least substantially vertical first pivot axis.

4. The articulated, steerable, toy vehicle of claim 3 wherein the steering lever is further pivotally coupled to the second wheeled vehicle portion at the second end for rotation about an at least substantially horizontal second pivot axis.

5. The articulated, steerable, toy vehicle of claim 4 wherein the steering lever is adjustable in length.

6. The articulated, steerable toy vehicle of claim 3 wherein the geared steering mechanism further comprises:

steering arms pivotally mounted to the first wheeled vehicle portion;

a third sector gear fixedly connected to the second wheeled vehicle portion;

a second idler gear rotatable engaged with the first wheeled vehicle portion and operably engaged with the third sector gear; and a fourth sector gear pivotally engaged to the steering arms and operably engaged with the second idler gear;

wherein the steering arms are pivoted relative to the first wheeled vehicle portion by rotation of the steering lever about the first pivot axis.

7. The articulated, steerable, toy vehicle of claim 1 further comprising an operable coupling including at least a slip clutch between the second end of the steering lever and the first wheeled vehicle portion.

8. An articulated, steerable, toy vehicle comprising:

a first wheeled vehicle portion;

a second wheeled vehicle portion pivotally coupled with the first wheeled vehicle portion; and a steering lever having a free first end and an opposing second end pivotally coupled to the second wheeled vehicle portion for lateral side-to-side movement of the first free end over the pivotally coupled first and second wheeled vehicle portions and operablv coupled to the first wheeled vehicle portion through the second wheeled vehicle portion such that lateral side-to-side pivotal movement of the free first end of the steering lever relative to the second wheeled vehicle portion pivots the first wheeled vehicle portion relative to the second wheeled vehicle portion; and an operable coupling including at least a slip clutch between the second end of the steering lever and the first wheeled vehicle portion wherein the slip clutch comprises:

a first clutch member fixedly coupled with the second end of the steering lever to rotate with the steering lever about the first pivot axis; and a second clutch member fixedly coupled with the first wheeled vehicle portion to rotate with the first wheeled vehicle portion about the first axis;

at least one of the first and second clutch members including a resilient engagement structure releasable engaging with a portion of the second clutch member to rotate the second clutch member below a threshold torque and to release and rotate with respect to the second clutch member above the threshold torque.

9. The articulated, steerable, toy vehicle of claim 7 wherein the slip clutch comprises:

a first rotational drive member connected with the second end of steering lever for pivotal movement with the steering lever about the first pivot axis;

a second rotational drive member fixedly connected to the first wheeled vehicle portion and having an open end with a hollow interior volume with an interior perimeter; and a cupped drive disk fixedly connected to the first rotational drive member for rotation with the first rotational drive member and having a circumferential outer perimeter at least partially received in the hollow interior, wherein the outer perimeter of the drive disk is sized and shaped to engage the inner perimeter of the interior volume to rotate the second rotational drive member below a threshold torque and to release and rotate with respect to the second rotational drive member above the threshold torque.

10. The articulated, steerable, toy vehicle of claim 9 wherein the circumferential outer perimeter of the drive disk is of a first polygon shape having a first number of sides and the inner perimeter of the second rotational drive member is of a second polygon shape having a second number of sides different from the first number.

11. The articulated, steerable, toy vehicle of claim 9 wherein the drive disk includes a plurality of slots through the circumferential outer perimeter.

12. The articulated, steerable, toy vehicle of claim 5 wherein the second end of the steering lever is further coupled to the second wheeled vehicle portion to rotate about an at least substantially horizontal, second pivot axis.

13. The articulated, steerable, toy vehicle of claim 1 wherein the steering lever is adjustable in length.

14. An articulated, steerable, toy vehicle comprising:

a first wheeled vehicle portion;

a second wheeled vehicle portion pivotally coupled with the first wheeled vehicle portion; and a steering lever having a free first end and an opposing second end pivotally coupled to the second wheeled vehicle portion for lateral side-to-side movement of the free first end over the pivotally coupled first and second wheeled vehicle portions and operably coupled to the first wheeled vehicle portion through the second wheeled vehicle portion such that lateral side-to-side pivotal movement of the free first end of the steering lever relative to the second wheeled vehicle portion pivots the first wheeled vehicle portion relative to the second wheeled vehicle portion, wherein the steering lever includes a track extending at least substantially along the length of the steering lever at least to and through the second end of the steering lever.

15. The articulated, steerable, toy vehicle of claim 14 further comprising an interior storage compartment within the first wheeled vehicle portion.

16. The articulated, steerable, toy vehicle of claim 15 wherein the track at the second end of the steering lever can be aligned with an opening in the first wheeled vehicle portion into the interior storage compartment to receive objects passed along the track through the second end of the steering lever.

17. A combination comprising the articulated, steerable, toy vehicle of claim 16 with at least one diminutive toy vehicle of a size sufficiently small to pass through a channel in the steering lever.

18. The articulated, steerable toy vehicle of claim 1 wherein the first wheeled vehicle portion is a tractor assembly and the second wheeled vehicle portion is a trailer assembly.

19. The articulated, steerable toy vehicle of claim 18 configured as a fire truck with the steering lever configured, at least in part, as a telescopic ladder on the trailer assembly.

20. The articulated, steerable, toy vehicle of claim 1 wherein the steering lever is pivotally coupled to the second wheeled vehicle portion proximal a forward end of the second wheeled vehicle portion adjoining a rear end of the first wheeled vehicle portion and wherein at least a portion of the steering lever most proximal to the at least generally vertical axis and extending transversely away from the at least generally vertical axis extends above the toy vehicle and remains elevated in height above the toy vehicle in all operable positions of the steering lever.

* * * * *